United States Patent [19]

Gavinet et al.

[11] Patent Number: 4,724,699

[45] Date of Patent: Feb. 16, 1988

[54] DRAWPLATE FOR HOT DRAWING

[75] Inventors: Jean Gavinet, Orsay; Michel Lebouc, Limours, both of France

[73] Assignee: Commissariat a l'Energie Atomique, Paris, France

[21] Appl. No.: 865,777

[22] Filed: May 22, 1986

[30] Foreign Application Priority Data

May 31, 1985 [FR] France ..... 85 08225

[51] Int. Cl.[4] ..... B21C 25/02

[52] U.S. Cl. ..... 72/467; 72/481

[58] Field of Search ..... 72/274, 467, 481

[56] References Cited

U.S. PATENT DOCUMENTS

| | | | |
|---|---|---|---|
| 3,680,354 | 8/1972 | Phillips | 72/467 |
| 4,241,625 | 12/1980 | Corbin et al. | 72/467 |
| 4,270,380 | 6/1981 | Gulati et al. | 72/467 |

FOREIGN PATENT DOCUMENTS

| | | | |
|---|---|---|---|
| 1413597 | 8/1965 | France . | |
| 1487972 | 7/1967 | France . | |
| 1551849 | 12/1968 | France . | |
| 1572342 | 6/1969 | France . | |
| 2080429 | 11/1971 | France . | |
| 2497126 | 7/1982 | France . | |
| 0370181 | 4/1932 | United Kingdom | 72/467 |
| 0549407 | 11/1942 | United Kingdom | 72/467 |
| 0565080 | 10/1944 | United Kingdom | 72/467 |
| 0664706 | 5/1979 | U.S.S.R. . | |

*Primary Examiner*—R. L. Spruill
*Assistant Examiner*—Donald R. Studebaker
*Attorney, Agent, or Firm*—James E. Nilles

[57] ABSTRACT

Drawplate for hot drawing. This drawplate comprises a central core hooped into a mount and is provided with an axial channel successively defining an intake cone, a working cone, a cylindrical bearing and an outlet. The mount is formed from two parts, which are assembled with one another with a small clearance. The clearance between the parts and the geometry thereof are such that during the drawing operation the core is subject to isostatic stressing. Therefore, it is possible to use for the production of the core, fragile materials, e.g. ceramic materials or refractory alloys, such as cobalt or molybdenum-based superalloys.

7 Claims, 2 Drawing Figures

DRAWPLATE FOR HOT DRAWING

BACKGROUND OF THE INVENTION

The present invention relates to a drawplate more particularly usable for the hot drawing or coupling of nickel, cobalt or titanium alloy sections, which can more particularly be used in jet aircraft engines.

Hot drawing processes are widely used for shaping metals or alloys, such as alloys of nickel or cobalt. In the case of these alloys, the temperatures required are generally high, being approximately 1000° to 1350° C. It is therefore necessary to use drawplates having good mechanical characteristics at these temperatures. Moreover, it is advantageous to be able to use the same drawplate for several drawing operations, whilst respecting the necessary dimensions with very small tolerances.

The drawplates used are generally constituted by a core hooped in a mount, the core e.g. being made from treated alloyed steel. Drawplates of this type can be suitable for obtaining articles having a circular cross-section, but also when it is wished to obtain refractory alloy sections with a complex shape, the hitherto used alloyed steel drawplates not making it possible to carry out several drawing operations under satisfactory conditions.

FIG. 1 is a vertical section of a drawplate according to the prior art. This drawplate is constituted by a core (1) hooped in a mount (3). In part, core (1) defines with mount (3) the drawing intake cone A, the core then defining the working cone B, the cylindrical bearing C and finally the mount defines the drawplate discharge channel D. The external shape of the upper part of the mount corresponds to that of the drawing container used which, in the present case is conical.

Such drawplates are not able to withstand high temperatures (of approximately 1150° to 1250° C.) and the high pressures (approximately 1300 MPa) necessary for shaping refractory cobalt or nickel alloys. Thus, during the drawing operation, the core (1) abuts against the mount (3) and the hooping stress is limited to the clamping force of the container, but the drawing force opposes said clamping force. Thus, it is difficult for the core to resist the drawing operation. Moreover, the upper end (1*a*) of the core in the drawplate intake cone cools rapidly, whereas the zone (1*b*) fitted into the mount constitutes a hot zone. Thus, breaking occurs in the drawplate due to thermal shocks.

French Pat. No. 2 497 126 discloses another type of drawplate, which is more particularly intended for drawing copper and aluminium alloys. This drawplate also comprises a joined core fitted into a mount, but the latter is formed from two components, which are arranged with a certain clearance from one another. However, such an arrangement does not make it possible to obtain the necessary resistance to high pressures and it is not suitable for the drawing and joint drawing of nickel, cobalt or titanium alloys.

SUMMARY OF THE INVENTION

The present invention therefore relates to a drawplate obviating the disadvantages of the prior art drawplates, whilst permitting the production of complex sections made from nickel, cobalt or titanium alloys.

The drawplate according to the invention, which comprises a central core hooped in a mount and which is provided with an axial channel, successively defining an intake cone, a working cone, a cylindrical bearing and a drawplate outlet is characterized in that core (11) is shaped like a straight frustum, having an axial channel defining at least the working cone B and the cylindrical bearing C of the drawplate and in that said mount is in the form of two parts 13, 14, respectively constituted by a hoop 13, at least partly defining the intake cone A of the drawplate and on the one hand surrounding the external frustum-shaped surface of said core and on the other the upper face of said core corresponding to the small base of the frustum and by a support 14 in contact with the inner face of the core 11 corresponding to the large base of the frustum, said support 14 being assembled with said hoop 13 by a system 15 making it possible to provide an adequate clearance between the hoop and the support so that, during the drawing operation, the support still exercises a pressure on the face of the core corresponding to the large base of the frustum.

According to a variant, the core is shaped like a straight cylinder and has an axial channel at least defining the working cone and cylindrical bearing of the drawplate, whereby said parts are respectively constituted by a hoop at least partly defining the intake cone of the drawplate and surrounding on the one hand the outer cylindrical surface of the core and on the other one of the faces of said core and by a support in contact with the other face of the core, said support being assembled with said hoop by a system making it possible to provide between said hoop and said support a clearance adequate to ensure that, during the drawing operation, the support still exerts a pressure on the face of the core with which it is in contact.

Advantageously the system for assembling the hoop and the support is contituted by screws screwed into the hoop, but able to slide in the said support.

In general, the core is placed in the hoop, so that there is a slight clearance between the hoop and the upper face of the core surrounded by the hoop and this clearance is filled during the first drawing operation.

The use, according to the invention, of a mount constituted by two parts which can subject the core to isostatic stressing during the drawing operation, makes it possible to obtain the desired resistance to the high temperature and pressure conditions involved in said operation.

Moreover, the use of a frustum-shaped or cylindrical core makes it possible to ensure that there is no breaking of the core under the effect of thermal shocks, because the point of the cone is eliminated, whilst retaining the continuity of the working angle.

Moreover, the use of a hoop at least partly forming the intake cone of the drawplate, which on the one hand surrounds the outer frustum-shaped surface of the core and on the other hand the face of said core corresponding to the small base of the frustum, makes it possible to obtain a prestressing of the core due to the action of the drawing container traverse. However, in the case of the drawplate described in French Pat. No. 2 497 126, such an isostatic stressing cannot be obtained, because in part the mount does not cover the joined core.

Finally, the drawplate according to the invention can be used for drawing alloys which are difficult to draw, such as alloys of nickel, cobalt or titanium, because the inlet of the drawplate is shaped like a cone. In the same way, it is possible to use it for the joint drawing at high temperature of billets and for hydrostatic drawing. For these applications, the drawplate intake cone preferably defines an angle well below 180°, e.g. 60° to 90°, or even below 60°. Thus, the drawplate according to the invention has numerous advantages compared with the prior art drawplates.

As a result of the present mount, it is possible to use for the core materials having widely varying expansion coefficients, which also differ greatly from the expansion coefficient of the hoop and the support. Thus, the core can be made from alloys which are sensitive to thermal shocks, but which are able to resist high temperature friction. It is also possible to make the core from ceramic materials with a very low expansion coefficient, because the application of an isostatic stress during drawing makes ceramic materials less fragile. The use of such refractory materials is of interest, because in this way it is possible to preheat the drawplate to relatively high temperatures, e.g. 500° to 600° C. and facilitate the drawing operation, whilst preventing thermal shocks, at the start of drawing, between the billet and the tools.

Examples of alloys able to withstand high temperatures and which can be used for producing the core are superalloys based on cobalt or molybdenum.

Under the action of the drawing pressure and temperature, these superalloy cores are slightly deformed by shrinkage, but it is easy to ensure the precise dimensions by recalibrating the profile of the axial channel of the core by spark erosion. As a function of the tolerances which it is wished to obtain, this recalibration can be performed after 4 to 8 consecutive drawing operations.

As was stated hereinbefore, it is also possible to make the core from a ceramic material. Ceramic materials which can be used can be refractory oxides or carbides, e.g. silicon, chromium or tungsten carbides. Preference is given to the use of refractory oxides, such as stabilized or unstabilized zirconia. The use of such ceramic cores is of interest, because they are little subject to dimensional variations and do not require recalibration.

The hoop and support are generally made from materials which are less susceptible to thermal shock action than the core and which have mechanical characteristics which are superior to those of the core, but at lower temperatures. Materials which can be used are treated alloyed steels, molybdenum alloys, titanium alloys and high melting point refractory metals.

Although in general the hoop and support are made from the same material, it is possible to use different materials for these two parts, provided that they are compatible with one another and make it possible to subject the core to isostatic stressing during drawing.

Due to their particular structure, the drawplates according to the invention can be used for different drawing operations. Thus, they are particularly suitable for semi-hydrostatic drawing of alloys of nickel, cobalt or titanium often required in a sheath during the drawing operation. In this case, the nickel alloy billet is surrounded by a soft steel tube calibrated by drawing and a soft steel plug is welded on one side of the tube. During drawing, the plug positioned upstream of the billet makes it possible to reduce the rapid cooling of the billet in contact with the tool. The billets are heated in such a way that their temperature is uniform and the container and drawplate are heated to a temperature of at least 350° C. The drawing operation is then started by using a rammer advance speed of approximately 3 m/min., which makes it possible to obtain products having an appropriate geometry over considerable lengths, whilst reducing wear to the drawplates. This followed by the elimination of the soft steel sheath by pickling in a nitric acid bath. The use of the drawplates according to the invention makes it possible to obtain very precise dimensions in this process without causing wear to the drawplate.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
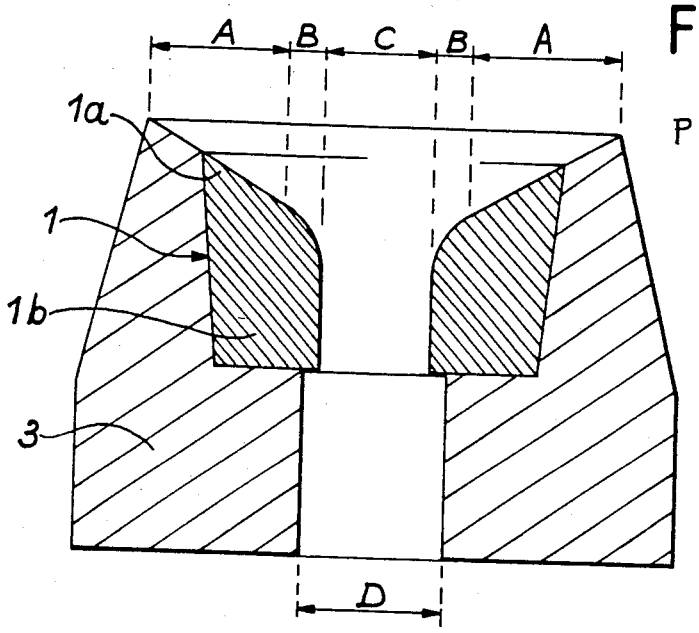
FIG. 1 PRIOR ART
FIG. 1, already described, a prior art drawplate.
Figure 2:
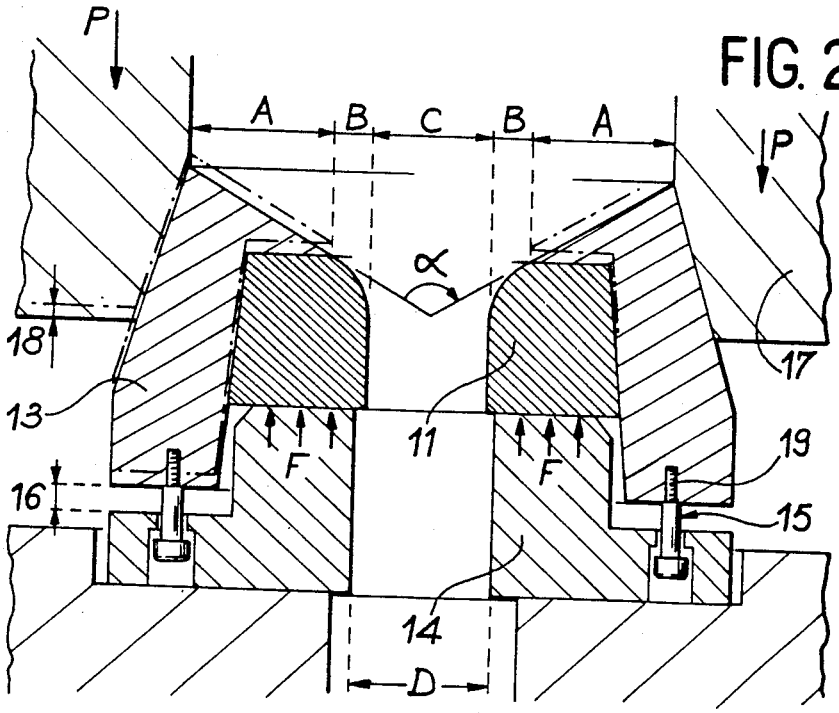
FIG. 2 in vertical section a drawplate according to the invention.

FIG. 2 shows that the drawplate comprises a core (11) hooped in a mount comprising first part or hoop (13) and a second part or support (14). Support (14) and hoop (13) are connected by a screw system (15), so that a clearance (16) can be left between them. The assembly constituted by core (11), hoop (13) and support (14) is mounted in a drawing die or press, partly in container (17) and the external shape of hoop (13) corresponds to that of the drawing container. Furthermore, in the case of this example, its external surface is frustum-shaped, like the lower part of container (17). Core (11) is shaped like a straight frustum and is provided with an axial channel defining at least the working cone B and the cylindrical bearing C of the drawplate. On its outer frustum-shaped surface and on its upper surface corresponding to the small base of the frustum, it is surrounded by hoop (13), which at least partly defines the intake cone A of the drawplate, whose opening angle $\alpha$ is below 180°. A small clearance (18) is provided during the fitting of the parts between the upper face of the core corresponding to the small base of the frustum and the hoop (13) and said clearance is such that it is filled during the first drawing operation, so that said core is subject to prestressing. This clearance is in particular dependent on the expansion coefficients of the hoop and the core. Generally, clearances of 0.5 to 1 mm are sufficient. In its lower part or on the inner face corresponding to the large base of the frustum, core (11) is in contact with support (14), which is also provided with a channel constituting the outlet D for the drawplate. This channel has the same profile as drawplate channel C, but has a slightly larger opening. Support (14) has an external shape such that in part it fits into hoop (13) and can be assembled therewith by providing clearance (16) which is such that during the drawing operation, support (14) still exerts a pressure on the inner face of core (11) corresponding to the large base of the frustum. The assembly system between the two parts is constituted by fastening means which comprise screws 19 and the openings in support 14 through which they pass. More specifically, and as clearly shown in FIG. 2, the screws (19) each include a shank which has an axis; an inner end adapted as by external threading, to be secured to said hoop by being threaded into internally threaded bores in said hoop in a position to mount the support 14; and an enlarged outer end. The assembly system also includes fastening means receiving openings in support 14 which are defined by wall portions in support 14. As shown in FIG. 2, the openings in support 14 for screws 19 are shaped to receive the shank of each screw 19 and dimensioned to provide a lateral space between the shank and the support walls which surround the shank of screw 19 and an axial space between said enlarged end and said support so that the screws can slide in support (14). Thus, during the drawing operation, an isostatic stressing of the core (11) is possible.

Thus, when a drawing pressure P is applied, the upper face of core (11) is subject to the drawing pressure, the outer frustum-shaped surface of the core is subject to pressure forces produced by the container in hoop (13) and the inner face of the core is subject to the pressure produced by part (14), due to the clearance (16) between hoop (13) and support (14). The inner surface of core (11) is subject to the action of the drawing forces. Therefore, there is an isostatic stressing of core (11), which leads to good mechanical characteristics. The clearance (16) provided between hoop (13) and support (14) is in particular dependent on the nature of the materials used for producing the hoop, the support and the core. In general, the hoop and support are made from the same material, but it would also be possible to use different materials. The essential thing is that the clearance provided for fitting purposes is such that during the application of the drawing pressure at the drawing temperature there is still a slight clearance between the two parts, so that support (14) applies a pressure in the direction of arrows F to the lower face of core (11). Fitting clearances of 5 to 10 mm are generally adequate.

For example, in the case of drawplates of this type, whereof the core is made from a cobalt alloy and the hoop and support from a treated alloyed steel, it has been possible to draw nickel alloy sections under the following conditions:

billet heating: 1150° C.,
drawing pressure: 1300 MPa,
drawplate preheating: 500° C.,
rammer advance speed: 3 $m.min^{-1}$ Using such drawplates, it has proved possible to produce articles with an appropriate geometry over considerable lengths, without the drawplate being damaged.

What is claimed is:

1. A drawplate comprising a mount and a core (11) secured in said mount, said core being in the shape of a frustrum and having an axial channel therethrough successively defining an intake cone (A), a working cone (B), a cylindrical bearing (C), an outlet (D), a small base upper face and a large base inner face, said mount including:

a hoop (13) adapted to receive and surround said core therein with said large base inner face being exposed, said hoop having portions which overlay said small base upper face of said core to at least partly define said intake cone;

a support (14) adapted for contact only with said exposed large base inner face of said core (11); and an assembly system (15) for securing said support to said hoop in contact only with said inner base face to permit movement of said support relative to said base face of the core during operation of said drawplate as required by varying coefficients of expansion of said core, hoop and support to maintain said core under isostatic stress.

2. A drawplate according to claim 1 wherein said assembly system comprises the combination of:

a fastening means each of which includes a shank having an axis and inner and outer ends, said inner end adapted to be secured to said hoop in a support mounting position, and said outer end being enlarged; and said support having wall portions defining fastening means receiving openings, said openings shaped to receive said shank therethrough but not said enlarged outer end and dimensioned to provide a space between said shank and said support wall positions, and wherein said enlarged outer end of said shank is axially spaced from said support when said inner end of said shank is secured to said hoop in said support mounting position.

3. A drawplate according to either of the claims 1 or 2 wherein said core is mounted in said hoop to present said small base upper face portion of said core in spaced relation to said hoop portions which overlay said small base upper face to provide a small clearance (18) therebetween which is filled during the first drawing operation.

4. A drawplate according to claim 3 wherein said core is made from a cobalt or molybdenum-based superalloy.

5. A drawplate according to claim 3, wherein said core is made from a ceramic material.

6. A drawplate according to claim 3 wherein said ceramic material is zirconia.

7. A drawplate according to claim 1 or 2, wherein said hoop and said support are made from treated alloyed steel, molybdenum alloy, titanium alloy or a refractory metal with a high melting point.

* * * * *